US007505717B2

(12) United States Patent
Seo et al.

(10) Patent No.: US 7,505,717 B2
(45) Date of Patent: Mar. 17, 2009

(54) IMAGE FORMING APPARATUS

(75) Inventors: In-sik Seo, Suwon-si (KR); In-yong Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 248 days.

(21) Appl. No.: 11/448,047

(22) Filed: Jun. 7, 2006

(65) Prior Publication Data

US 2007/0009288 A1 Jan. 11, 2007

(30) Foreign Application Priority Data

Jul. 7, 2005 (KR) ..... 10-2005-0061096

(51) Int. Cl.
*G03G 15/08* (2006.01)

(52) U.S. Cl. ..... 399/258; 399/119; 399/120

(58) Field of Classification Search ..... 399/119, 399/120, 252, 258, 260, 262, 263; 222/DIG. 1
See application file for complete search history.

(56) References Cited

U.S. PATENT DOCUMENTS 5,426,492 A * 6/1995 Diehl ..... 399/262
5,585,899 A 12/1996 Palumbo et al.
5,909,609 A * 6/1999 Yahata et al. ..... 399/258
7,062,207 B2 * 6/2006 Tsuda et al. ..... 399/260
7,076,192 B2 * 7/2006 Tsuda et al. ..... 399/258

FOREIGN PATENT DOCUMENTS

| | | |
|---|---|---|
| JP | 05-333694 | 12/1993 |
| JP | 8-22187 | 1/1996 |
| JP | 8-30084 | 2/1996 |
| JP | 11-305537 | 11/1999 |
| KR | 98-3911 | 3/1998 |
| KR | 2001-20889 | 3/2001 |
| KR | 2001-100785 | 11/2001 |

OTHER PUBLICATIONS

Office Action issued in Korean Patent Application No. 2005-61096 on Jul. 21, 2006.
Office Action issued in Chinese Patent Application No. 2006101031746 on Mar. 28, 2008.

* cited by examiner

*Primary Examiner*—Hoan H Tran
(74) *Attorney, Agent, or Firm*—Stein, McEwen & Bui, LLP

(57) ABSTRACT

An image forming apparatus is provided with a body; a developing unit formed inside the body; a toner accommodation unit mounted inside the body and provided with at least two or more cartridges; and a toner supply unit for supplying toner discharged from each cartridge of the toner accommodation unit to the developing unit, such that a user can easily change the toner.

22 Claims, 2 Drawing Sheets

IMAGE FORMING APPARATUS

CROSS-REFERENCE TO RELATED APPLICATIONS

This application claims all benefits accruing under 35 U.S.C. §119 from Korean Patent Application No. 2005-61096, filed Jul. 7, 2005, the content of which is incorporated by reference herein.

BACKGROUND OF THE INVENTION

1. Field of the Invention

The present invention relates to an image forming apparatus whereby a user can easily change toner.

2. Related Art

Generally, a small-sized image forming apparatus, such as a laser printer, a compact photo-copier, a facsimile machine or a multi-functional product, utilizes a developing unit provided with toner. However, in case of an image forming apparatus that needs a large quantity of toner, a toner container is separately installed to accommodate the toner.

FIG. 1 is a schematic drawing of an engine part of an image forming apparatus such as a printer equipped with a large capacity toner container. Referring to FIG. 1, an image forming apparatus includes a paper cassette 10, a paper feeding unit 20, a developing unit 30, a transfer unit 40, a fixing unit 50 and a toner cartridge 60. The toner included in the toner cartridge 60 is supplied to the developing unit 30 by a toner convey unit 70.

The paper cassette 10 accommodates many sheets of printing paper, and the paper feeding unit 20 supplies the individual sheet of printing paper to the developing unit 30 and the transfer unit 40. The developing unit 30 forms a predetermined toner image, and the transfer unit 40 transfers the toner image on the printing paper.

The fixing unit 50 applies heat and pressure to an image electrostatically attached to the transfer unit 40 and fixes an electrostatic image on the printing paper. The toner cartridge 60 is accommodated with toner supplied to the developing unit 30, and the toner is supplied to the developing unit 30 by the toner convey unit 70.

However, the toner cartridge 60 used in conventional image forming apparatuses is bulky due to accommodation of a large quantity of toner for printing many sheets of printing paper. As a result, a user often has difficulty in changing the toner cartridge 60 due to heavy weight of the toner cartridge 60. Moreover, there is another disadvantage in that a large space is required inside an image forming apparatus due to the size of the toner cartridge 60, as shown, for example, in FIG. 1.

SUMMARY OF THE INVENTION

Several aspects and example embodiments of the present invention provide an image forming apparatus in which a user can easily change a toner cartridge and maximize the use of an inner space of such an image forming apparatus.

Additional aspects and/or advantages of the invention will be set forth in part in the description which follows and, in part, will be obvious from the description, or may be learned by practice of the invention.

In accordance with an aspect of the present invention, an image forming apparatus is provided with a body inherently formed therein with a developing unit; a toner accommodation unit mounted inside the body and provided with at least two or more cartridges; and a toner supply unit for supplying toner discharged from each cartridge of the toner accommodation unit to the developing unit.

According to an embodiment of the present invention, the toner accommodation unit comprises: first and second cartridges each accommodated therein with toner; and a housing attachably and detachably mounted with the first and second cartridges.

According to a first embodiment of the present invention, the image forming apparatus is so constructed as to allow the toner in the second cartridge to be discharged if the toner in the first cartridge is totally consumed.

According to a second embodiment of the present invention, the image forming apparatus is so constructed as to allow the toner in the first and second cartridges to be discharged altogether.

According to an aspect of the present invention, the first and second cartridges are disposed with toner discharge outlets that open when attached to the housing. The toner supply unit comprises: a toner convey tube mounted with a toner inlet into which the toner discharged from each cartridge is introduced and a toner outlet; and a convey path disposed inside the toner convey tube and forcibly conveying the toner introduced through the toner inlet toward the toner outlet. The toner convey tube is downwardly inclined toward the developing unit, and the convey path is implemented by a conveyer belt or an auger.

In addition to the example embodiments and aspects as described above, further aspects and embodiments of the present invention will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
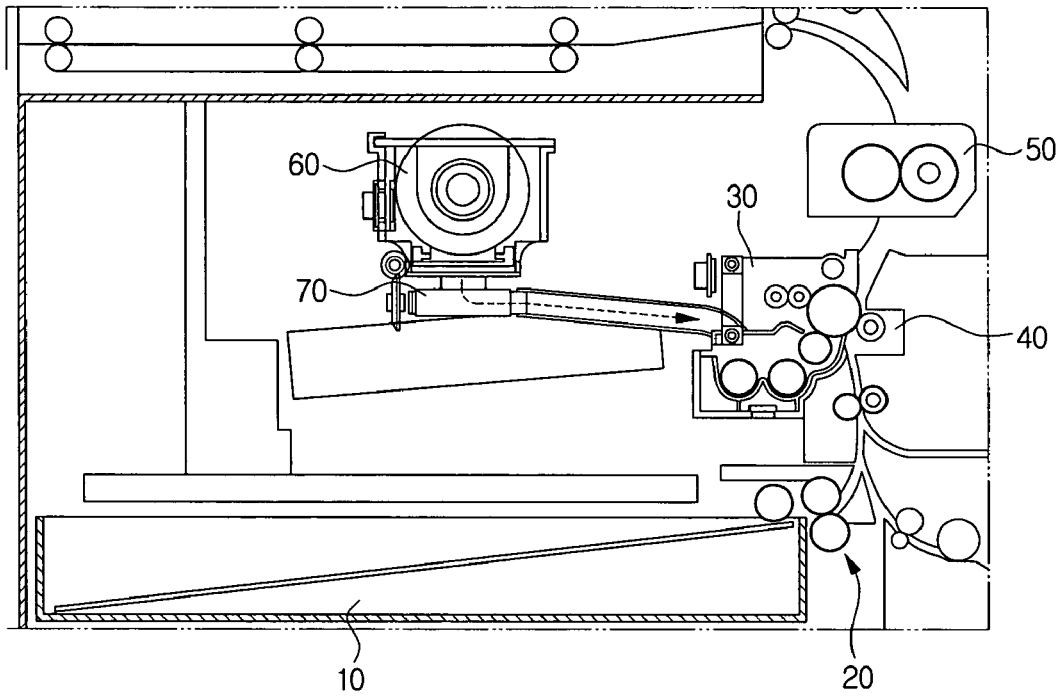
FIG. 1 (PRIOR ART)
FIG. 1 is a schematic representation of a typical image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

However, well-known functions or constructions are not described in detail since they would obscure the invention in unnecessary detail.

Figure 2:
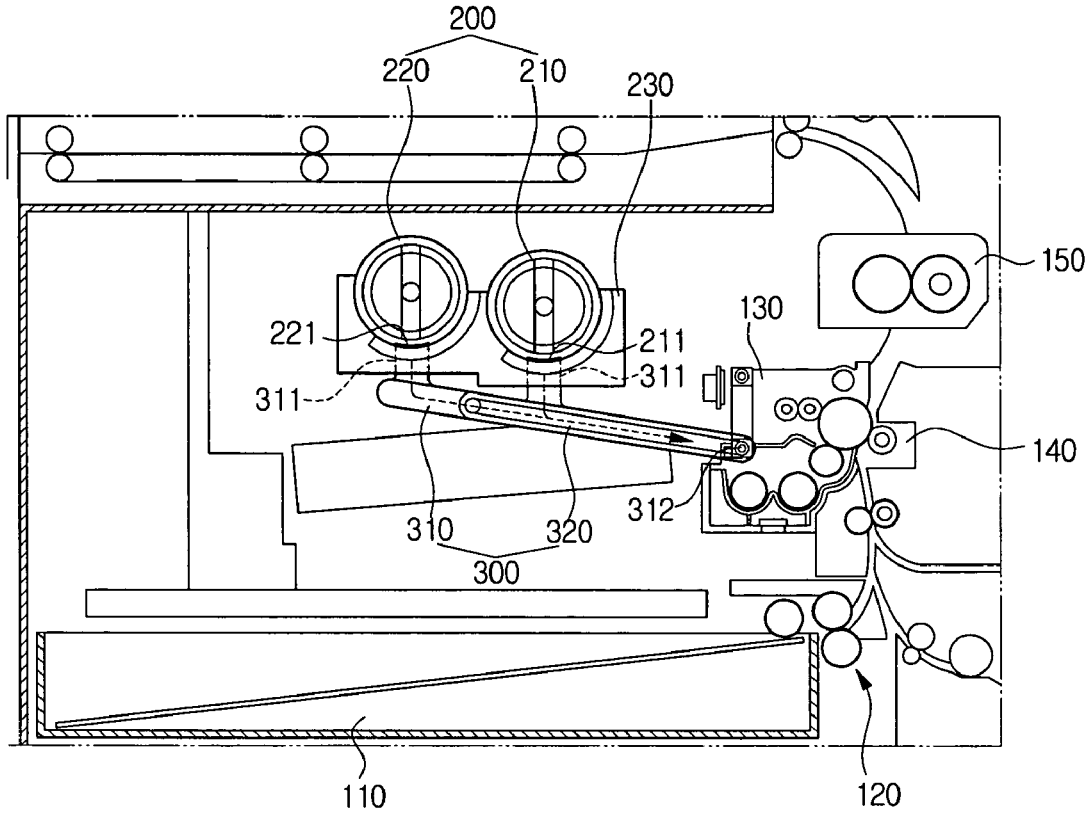
FIG. 2 is a schematic representation of an example image forming apparatus according to an embodiment of the present invention.

Referring to FIG. 2, an image forming apparatus according to an embodiment of the present invention includes a paper cassette 110, a paper feeding unit 120, a developing unit 130, a transfer unit 140, a fixing unit 150, a toner accommodation unit 200 and a tone convey unit 300.

The toner accommodated in the toner accommodation unit 200 is supplied to the developing unit 130 via a toner convey unit 300.

The paper cassette 110 accommodates many sheets of printing paper, and the paper feeding unit 120 supplies the individual sheet of printing paper accommodated in the paper cassette 110 to the developing unit 130 and the transfer unit 140.

The developing unit 130 forms a predetermined toner image, and the transfer unit 140 transfers the toner image on the printing paper.

The fixing unit 150 applies heat and pressure to an image electrostatically attached to the transfer unit 140 and fixes the electrostatic image on the printing paper.

The toner accommodation unit 200 includes a first cartridge 210 and a second cartridge 220 each accommodated therein with toner, and a housing 230 attachably and detachably mounted with the first and second cartridges 210 and 220.

The first and second cartridges 210 and 220 are disposed with toner discharge outlets 211 and 221 that open when attached to the housing 230.

According to a first embodiment of the present invention, the second cartridge 220 is configured to supply toner accommodated therein to the developing unit 130 and the transfer unit 140, when the toner accommodated inside the first cartridge 210 is totally consumed.

At this time, the image forming apparatus can operate normally even if the first cartridge 210, which is deleted with toner, is removed from the housing 230.

The toner discharge outlet 221 formed at the second cartridge 220 may be selectively opened or closed so that the toner can be supplied to the developing unit 130 and the transfer unit 140, when the first cartridge 210 is deleted with toner. A convey operation of the toner convey (supply) unit 300 may be controlled to convey toner from the first cartridge 210 and/or the second cartridge 220.

According to a second embodiment of the present invention, the first and second cartridges 210 and 220 can be configured to simultaneously supply toner accommodated therein to the developing unit 130 and the transfer unit 140. In such an embodiment, the toner discharge outlets 211 and 221 formed at the first and second cartridges 210 and 220 are simultaneously opened or closed so that the toner accommodated inside each cartridge is supplied to the developing unit 130 and the transfer unit for image formation.

According to the first and second embodiments of the present invention, the first cartridge 210 may be mounted at a position a slightly lower than that of the second cartridge 220 so that the toner inside the first cartridge 210 can be first consumed.

The toner convey (supply) unit 300 is arranged at an inclined angle towards the developing unit 130, and includes a toner convey tube 310 arranged to receive toner from the first cartridge 210 and/or the second cartridge 220, and a toner convey path 320 to convey the toner towards the developing unit 130. In addition, the toner convey unit 300 includes a toner inlet 311 connected to the first and second cartridges 210 and 220 to direct the toner into the toner convey tube 310, and an outlet 312 connected to the developing unit 130 to direct the toner on the toner convey path 320 into the developing unit 130.

The tone inlet 311 supplies the toner discharged from the first and second cartridges 210 and 220 to the toner convey tube 310, and the outlet 312 discharges the toner introduced to the toner convey tube 310 to the developing unit 130.

The convey path 320 formed inside the tone convey tube 310 forcibly conveys the toner supplied, via the toner inlet 311, toward the developing unit 130, and may be constructed in a conveyor belt type or an auger type.

Hereinafter, the operation of an image forming apparatus according to an embodiment of the present invention will be described as follows.

When a printing is started, each individual sheet of printing paper accommodated inside the paper cassette 110 is picked up and conveyed by the paper feeding unit 120 and transferred to the developing unit 130 and the transfer unit 140 to form a printing image and the printing image is fixed by the fixing unit 150.

The toner to be consumed for the printing job is supplied to the developing unit 130 from the toner accommodation unit 200, via the convey unit 300.

The toner accommodation unit 200 is mounted with a first cartridge 210 and the second cartridge 220, each individually attachable and detachable, and depending upon an embodiment of the present invention, sequentially discharge the toner. For example, the second cartridge 220 can be so controlled as not to discharge the accommodated toner unless the toner inside the first cartridge 210 is totally consumed.

Furthermore, when the first cartridge 210 is consumed, a user can remove the first cartridge 210 that is depleted with toner, and then replace the same with a new cartridge full with toner.

Meanwhile, the image forming apparatus according to example embodiments of the present invention can be continuously operated by using the second cartridge 220, even though the first cartridge 210 is not removed and replaced with a new one.

As discussed previously, there is an advantage in that if a plurality of cartridges which are less bulky and smaller in size than those used in conventional image forming apparatuses, a user can easily conduct the cartridge replacing operation, and the image forming apparatus can be continuously used until a new cartridge is supplied even though there is no extra cartridge.

As apparent from the foregoing, a user can easily change the toner because a small sized cartridge that is depleted with toner can be simply replaced. Furthermore, a plurality of small-sized less bulky cartridges are installed, a space inside the image forming apparatus can be reduced to thereby enable an efficient use of the interior space.

While the multiple cartridge configuration of an image forming apparatus of the present invention has been particularly shown and described with reference to example embodiments thereof, it will be understood by those of ordinary skill in the art that various changes in form and details may be made therein without departing from the spirit and scope of the present invention. For example, components of an image forming apparatus can be arranged differently. In addition, other types of toner cartridges and a toner convey unit may also be provided. Accordingly, it is intended, therefore, that the present invention not be limited to the various example embodiments disclosed, but that the present invention includes all embodiments failing within the scope of the appended claims.

What is claimed is:

1. An image forming apparatus comprising:

a body;

a developing unit formed inside the body;

a toner accommodation unit mounted inside the body and provided with at least two or more cartridges; and a toner convey unit for conveying toner discharged from each cartridge of the toner accommodation unit to the developing unit for image formation, wherein the toner convey unit comprises:

a toner convey tube mounted with a toner inlet into which the toner discharged from each cartridge is introduced and a toner outlet; and a convey path disposed inside the toner convey tube and forcibly conveying the toner introduced, via the toner inlet, toward the developing unit, via the toner outlet.

2. The image forming apparatus as claimed in claim 1, wherein the toner accommodation unit comprises:

first and second cartridges each accommodated therein with toner; and a housing attachably and detachably mounted with the first and second cartridges.

3. The image forming apparatus as claimed in claim 2, wherein the toner in the second cartridge is discharged if the toner in the first cartridge is totally consumed.

4. The image forming apparatus as claimed in claim 2, wherein the toner in the first and second cartridges is discharged simultaneously.

5. The image forming apparatus as claimed in claim 2, wherein the first and second cartridges are disposed with toner discharge outlets that open when attached to the housing.

6. The image forming apparatus as claimed in claim 1, wherein the toner inlet is coupled to a toner discharge outlet of each cartridge to direct toner discharged from each cartridge into the convey path.

7. The image forming apparatus as claimed in claim 6, wherein the toner convey tube is arranged in an inclined angle toward the developing unit.

8. The image forming apparatus as claimed in claim 6, wherein the convey path is implemented by a conveyer belt.

9. The image forming apparatus as claimed in claim 6, wherein the convey path is implemented by an auger.

10. An image forming apparatus comprising:

a developing unit arranged to form a toner image on a printable medium;

a toner accommodation unit provided with at least two toner cartridges to discharge toner to the developing unit; and a toner convey unit arranged to convey toner discharged from each cartridge to the developing unit for image formation, wherein the toner convey unit comprises:

a toner convey tube provided with one or more toner inlets coupled to receive toner discharged from one or more toner cartridges respectively, and a toner outlet coupled to discharge toner into the developing unit; and a convey path disposed inside the toner convey tube to convey the toner introduced, via the one or more toner inlets, toward the developing unit, via the toner outlet.

11. The image forming apparatus as claimed in claim 10, wherein the toner accommodation unit comprises:

a housing;

a first cartridge mountable in the housing to store toner, and having a toner discharge outlet to discharge toner;

a second cartridge mountable in the housing to store toner, and having a toner discharge outlet to discharge toner.

12. The image forming apparatus as claimed in claim 11, wherein the second cartridge is configured to discharge toner only if the toner in the first cartridge is depleted.

13. The image forming apparatus as claimed in claim 11, wherein the first cartridge and the second cartridge are configured to discharge toner simultaneously, and each of the first and second cartridges is independently replaceable without affecting a toner discharge operation of a remaining one of the first and second cartridges.

14. The image forming apparatus as claimed in claim 11, wherein the first cartridge and the second cartridge are disposed with toner discharge outlets that open when mounted to the housing.

15. The image forming apparatus as claimed in claim 14, wherein the convey path is implemented by a conveyer belt.

16. The image forming apparatus as claimed in claim 14, wherein the toner convey tube is arranged in an inclined angle toward the developing unit so that toner can be conveyed from the one or more toner inlets toward the developing unit, via the toner outlet.

17. The image forming apparatus as claimed in claim 15, wherein the convey path is implemented by an auger.

18. An image forming apparatus comprising:

a developing unit arranged to form a toner image on a printable medium;

a toner accommodation unit mounted on an upper portion of the developing unit, having a first cartridge and a second cartridge that are replaceable and mountable therein to store toner, each of which is provided with a toner discharge outlet to discharge toner; and a toner convey unit mounted on a lower portion of the toner accommodation unit and arranged to convey toner discharged from each cartridge to the developing unit for image formation.

19. The image forming apparatus as claimed in claim 18, wherein the second cartridge is configured to discharge toner only if the toner in the first cartridge is depleted.

20. The image forming apparatus as claimed in claim 18, wherein the first cartridge and the second cartridge are disposed with toner discharge outlets that open when mounted to the housing to discharge toner simultaneously, and each of the first and second cartridges is independently replaceable without affecting a toner discharge operation of a remaining one of the first and second cartridges.

21. The image forming apparatus as claimed in claim 18, wherein the toner supply unit comprises a toner convey tube provided with one or more toner inlets coupled to the toner discharge outlets of the first and second cartridges to receive toner discharged from the first cartridge and/or the second cartridge, a toner outlet, and a convey path disposed inside the toner convey tube to convey the toner introduced, via the one or more toner inlets, toward the toner outlet.

22. The image forming apparatus as claimed in claim 18, wherein the first cartridge is disposed below the second cartridge.

* * * * *